US008387309B2

(12) United States Patent
Tseng

(10) Patent No.: US 8,387,309 B2
(45) Date of Patent: Mar. 5, 2013

(54) AUTOMATIC WATERPROOF GATE

(75) Inventor: Lung-Yuan Tseng, Taipei Hsien (TW)

(73) Assignee: Li-Yu Tseng, Taipei Hsien (TW)

( * ) Notice: Subject to any disclaimer, the term of this patent is extended or adjusted under 35 U.S.C. 154(b) by 313 days.

(21) Appl. No.: 12/833,204

(22) Filed: Jul. 9, 2010

(65) Prior Publication Data

US 2012/0005960 A1 Jan. 12, 2012

(51) Int. Cl.
*E05F 15/08* (2006.01)

(52) U.S. Cl. ..... 49/199; 49/197; 49/360; 49/414; 49/415; 49/416; 49/303

(58) Field of Classification Search ..... 49/324, 49/197, 198, 199, 360, 414, 415, 416, 303, 49/209, 210; 405/103, 104, 106; 160/201, 160/209

See application file for complete search history.

(56) References Cited

U.S. PATENT DOCUMENTS 459,533 A * 9/1891 Muller ..... 114/120
3,401,527 A * 9/1968 Palmer et al. ..... 405/105
6,427,718 B1 * 8/2002 Stringam et al. ..... 137/392
6,737,968 B1 * 5/2004 Ergun et al. ..... 340/540
6,826,867 B1 * 12/2004 McDonald et al. ..... 49/213
7,114,878 B2 * 10/2006 Craig et al. ..... 405/99
7,367,161 B1 * 5/2008 Jones ..... 49/334
2003/0026658 A1 * 2/2003 Wu ..... 405/87
2003/0026659 A1 * 2/2003 Wu ..... 405/87
2005/0081447 A1 * 4/2005 Kline ..... 49/209
2005/0129463 A1 * 6/2005 Craig et al. ..... 405/99

* cited by examiner

*Primary Examiner* — Katherine w Mitchell
*Assistant Examiner* — Marcus Menezes
(74) *Attorney, Agent, or Firm* — Alan Kamrath; Kamrath IP Lawfirm, P.A.

(57) ABSTRACT

A waterproof gate includes a door frame, two side rails mounted on two opposite sides of the door frame, a waterproof door movably mounted between the two side rails, at least one sealing gasket mounted on the waterproof door, and at least one waterproof strip mounted between the waterproof door and the door frame. Thus, when the water level exceeds a preset value, the waterproof door is moved down to press the ground tightly so that the waterproof door blocks the door frame so as to provide a waterproof effect to the door frame.

6 Claims, 6 Drawing Sheets

AUTOMATIC WATERPROOF GATE

BACKGROUND OF THE INVENTION

1. Field of the Invention

The present invention relates to a gate and, more particularly, to an automatic waterproof gate for a door.

2. Description of the Related Art

A conventional door comprises a door frame mounted in the wall of a house, a door panel having a first side pivotally mounted on the door frame by a plurality of hinges and a door knob mounted on a second side of the door panel. However, the conventional door does not have a waterproof function. Thus, when a natural accident or disaster, such as typhoon, flood and the like, happens, the water level easily exceeds a preset value so that water of the outside will enter the house from the door, thereby greatly causing danger and loss to the people in the house.

BRIEF SUMMARY OF THE INVENTION

In accordance with the present invention, there is provided a waterproof gate, comprising a door frame, two side rails mounted on two opposite sides of the door frame, a waterproof door movably mounted between the two side rails, at least one sealing gasket mounted on the waterproof door, and at least one waterproof strip mounted between the waterproof door and the door frame.

The waterproof gate further comprises a casing mounted on an upper end of the door frame, a pressing bar movable to abut an upper end of the waterproof door so as to press the waterproof door downward, and a first hydraulic cylinder unit pivotally connected with the pressing bar to move the pressing bar relative to the waterproof door.

The waterproof gate further comprises a pressing plate movable to abut the waterproof door so as to press the waterproof door toward the waterproof strip and to press the waterproof strip toward the door frame so that the door frame, the waterproof strip, and the waterproof door are combined closely, a drive lever pivotally connected with the pressing plate to move the pressing plate relative to the waterproof door, a push lever pivotally connected with the drive lever to move the drive lever, and a second hydraulic cylinder unit pivotally connected with the push lever to move the push lever.

The waterproof gate further comprises an automatic controller mounted in the casing and electrically connected with the waterproof door to control upward and downward movement of the waterproof door, a drive motor mounted in the casing to drive the automatic controller, a hydraulic pump mounted in the casing and connected with the first hydraulic cylinder unit and the second hydraulic cylinder unit to supply hydraulic oil to the first hydraulic cylinder unit and the second hydraulic cylinder unit, and an uninterrupted power system mounted in the casing to supply an electric power when electricity fail occurs.

The waterproof gate further comprises an infrared safety detector mounted on a lower end of one of the two side rails. The waterproof gate further comprises a water level detector disposed at a location flush with a bottom of each of the two side rails.

The pressing bar is pivotally mounted in the casing and has a first end pivotally connected with the casing and a second end that is pivotally connected with the first hydraulic cylinder unit and is movable to abut the upper end of the waterproof door. The first hydraulic cylinder unit is pivotally mounted in the casing and has an upper end pivotally connected with the casing and a lower end pivotally connected with the second end of the pressing bar.

The waterproof door is disposed between the pressing plate and the waterproof strip. The pressing plate is movably mounted in one of the two side rails and is connected with the push lever and the drive lever. The drive lever 142 is pivotally mounted in one of the two side rails and has a first end pivotally connected with one of the two side rails and a second end pivotally connected with the push lever. The push lever is pivotally mounted in one of the two side rails and has a lower end pivotally connected with the second end of the drive lever and an upper end pivotally connected with the second hydraulic cylinder unit. The second hydraulic cylinder unit is pivotally mounted in one of the two side rails and has a lower end pivotally connected with the upper end of the push lever and an upper end pivotally connected with one of the two side rails.

According to the primary advantage of the present invention, when the water level exceeds a preset value, the waterproof door is moved down to press the ground tightly so that the waterproof door blocks the door frame so as to provide a waterproof effect to the door frame.

According to another advantage of the present invention, the pressing bar is driven downward by the first hydraulic cylinder unit to press the waterproof door downward so that the waterproof door presses the ground tightly so as to enhance the waterproof effect.

According to a further advantage of the present invention, the waterproof door and the sealing gasket are compressed by the pressing bar so that the waterproof door and the sealing gasket are combined closely so as to enhance the waterproof effect.

According to a further advantage of the present invention, the push lever is driven downward by the second hydraulic cylinder unit to move the drive lever which is driven to move the pressing plate to abut the waterproof door so as to press the waterproof door transversely toward the waterproof strip and to press the waterproof strip toward the door frame so that the door frame the waterproof strip and the waterproof door are combined closely so as to enhance the waterproof effect.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
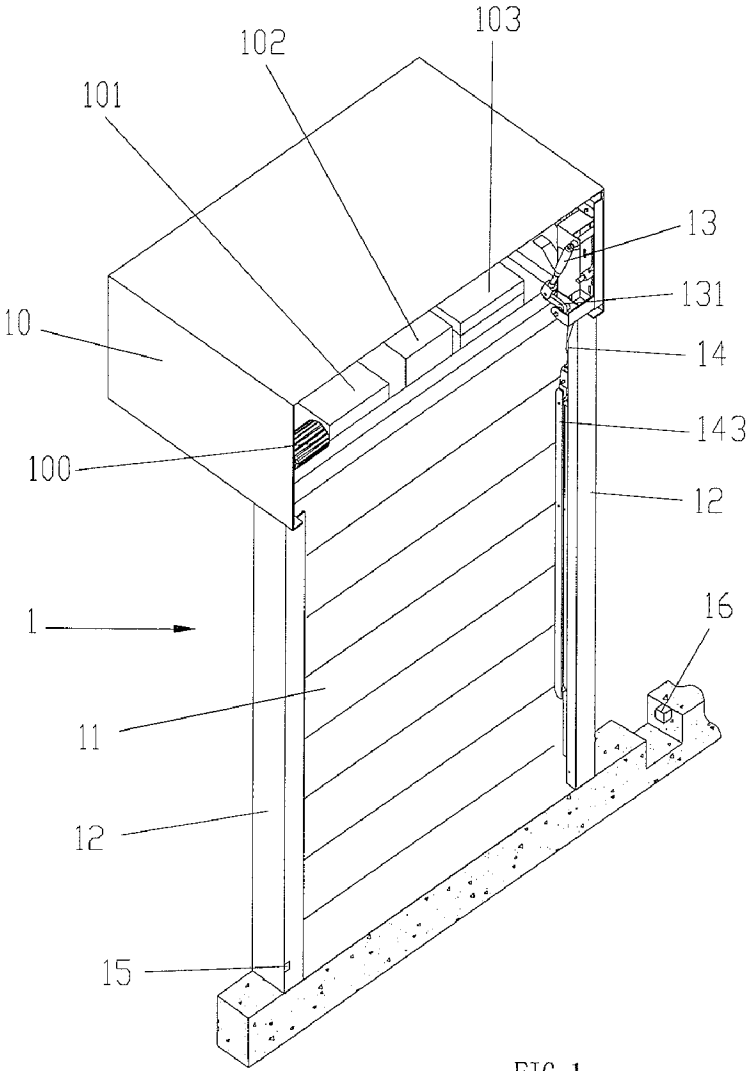
FIG. 1 is a perspective view of a waterproof gate in accordance with the preferred embodiment of the present invention.

Referring to the drawings and initially to FIGS. 1-4, a waterproof gate 1 in accordance with the preferred embodiment of the present invention comprises a door frame 2, two side rails 12 mounted on two opposite sides of the door frame 2, a waterproof door 11 movably mounted between the two side rails 12, at least one sealing gasket 111 mounted on the waterproof door 11, and at least one waterproof strip 112 mounted between the waterproof door 11 and the door frame 2.

The waterproof gate 1 further comprises a casing 10 mounted on an upper end of the door frame 2, a pressing bar 131 movable to abut an upper end of the waterproof door 11 so as to press the waterproof door 11 downward, and a first hydraulic cylinder unit 13 pivotally connected with the pressing bar 131 to move the pressing bar 131 relative to the waterproof door 11.

The pressing bar 131 is pivotally mounted in the casing 10 and has a first end pivotally connected with the casing 10 and a second end that is pivotally connected with the first hydraulic cylinder unit 13 and is movable to abut the upper end of the waterproof door 11. The first hydraulic cylinder unit 13 is pivotally mounted in the casing 10 and has an upper end pivotally connected with the casing 10 and a lower end pivotally connected with the second end of the pressing bar 131.

The waterproof gate 1 further comprises a pressing plate 143 movable to abut the waterproof door 11 so as to press the waterproof door 11 toward the waterproof strip 112 and to press the waterproof strip 112 toward the door frame 2 so that the door frame 2, the waterproof strip 112, and the waterproof door 11 are combined closely, a drive lever 142 pivotally connected with the pressing plate 143 to move the pressing plate 143 relative to the waterproof door 11, a push lever 141 pivotally connected with the drive lever 142 to move the drive lever 142, and a second hydraulic cylinder unit 14 pivotally connected with the push lever 141 to move the push lever 141.

The pressing plate 143 is movably mounted in one of the two side rails 12 and is connected with the push lever 141 and the drive lever 142. The waterproof door 11 is disposed between the pressing plate 143 and the waterproof strip 112. The drive lever 142 is pivotally mounted in one of the two side rails 12 and has a first end pivotally connected with one of the two side rails 12 and a second end pivotally connected with the push lever 141. The push lever 141 is pivotally mounted in one of the two side rails 12 and has a lower end pivotally connected with the second end of the drive lever 142 and an upper end pivotally connected with the second hydraulic cylinder unit 14. The second hydraulic cylinder unit 14 is pivotally mounted in one of the two side rails 12 and has a lower end pivotally connected with the upper end of the push lever 141 and an upper end pivotally connected with one of the two side rails 12.

The waterproof gate 1 further comprises an automatic controller 102 mounted in the casing 10 and electrically connected with the waterproof door 11 to control upward and downward movement of the waterproof door 11, a drive motor 100 mounted in the casing 10 to drive the automatic controller 102, a hydraulic pump 101 mounted in the casing 10 and connected with the first hydraulic cylinder unit 13 and the second hydraulic cylinder unit 14 to supply hydraulic oil to the first hydraulic cylinder unit 13 and the second hydraulic cylinder unit 14, and an uninterrupted power system 103 mounted in the casing 10 to supply an electric power when electricity fail occurs.

The waterproof gate 1 further comprises an infrared safety detector 15 mounted on a lower end of one of the two side rails 12 to detect if a foreign object passes between the two side rails 12, and a water level detector 16 disposed at a location flush with a bottom of each of the two side rails 12 to detect if the water level exceeds a preset value.

Figure 2:
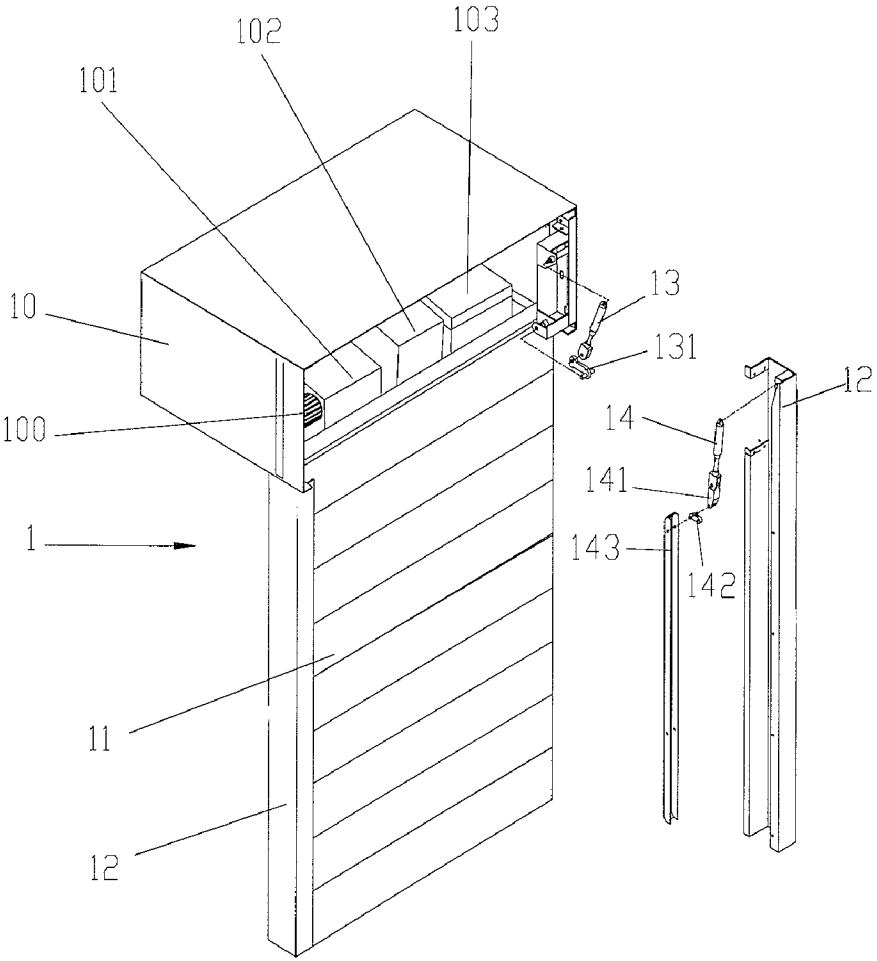
FIG. 2 is a partially exploded perspective view of the waterproof gate as shown in FIG. 1.
Figure 3:
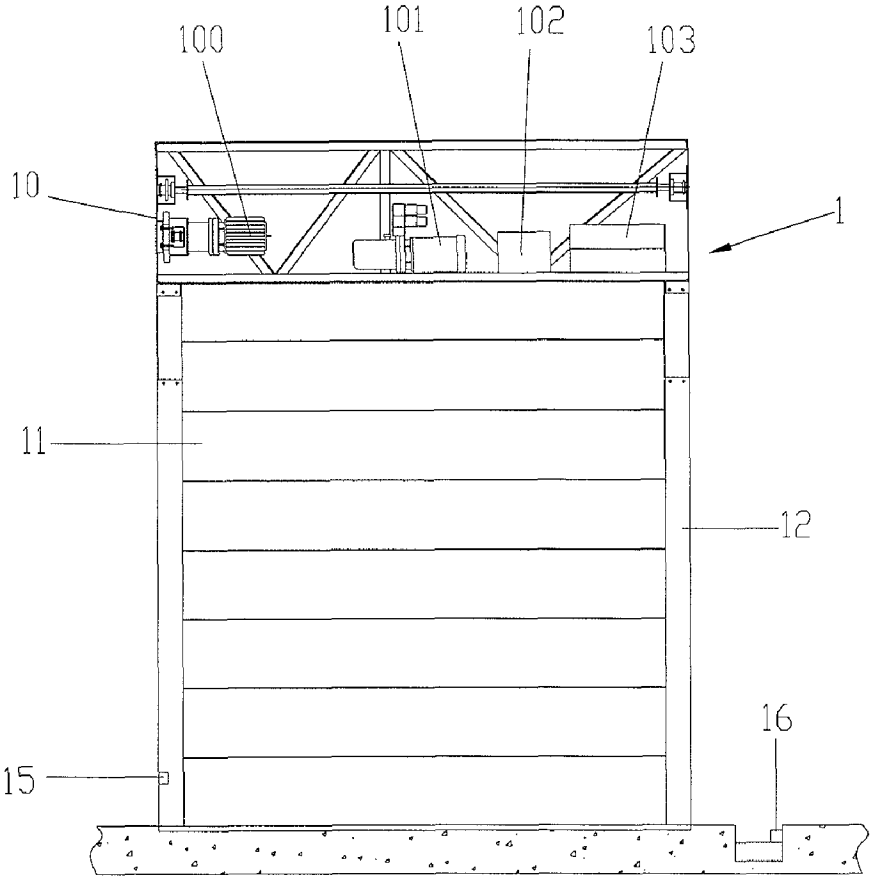
FIG. 3 is a front view of the waterproof gate as shown in FIG. 1.
Figure 4:
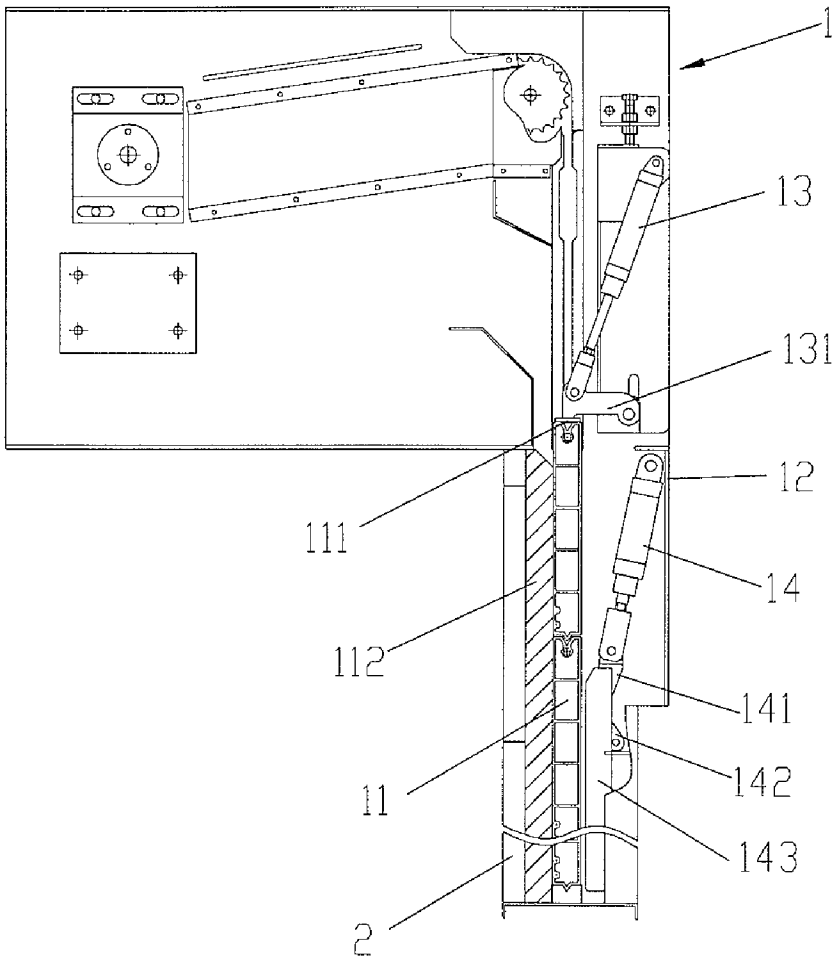
FIG. 4 is a side cross-sectional view of the waterproof gate as shown in FIG. 1.
Figure 6:
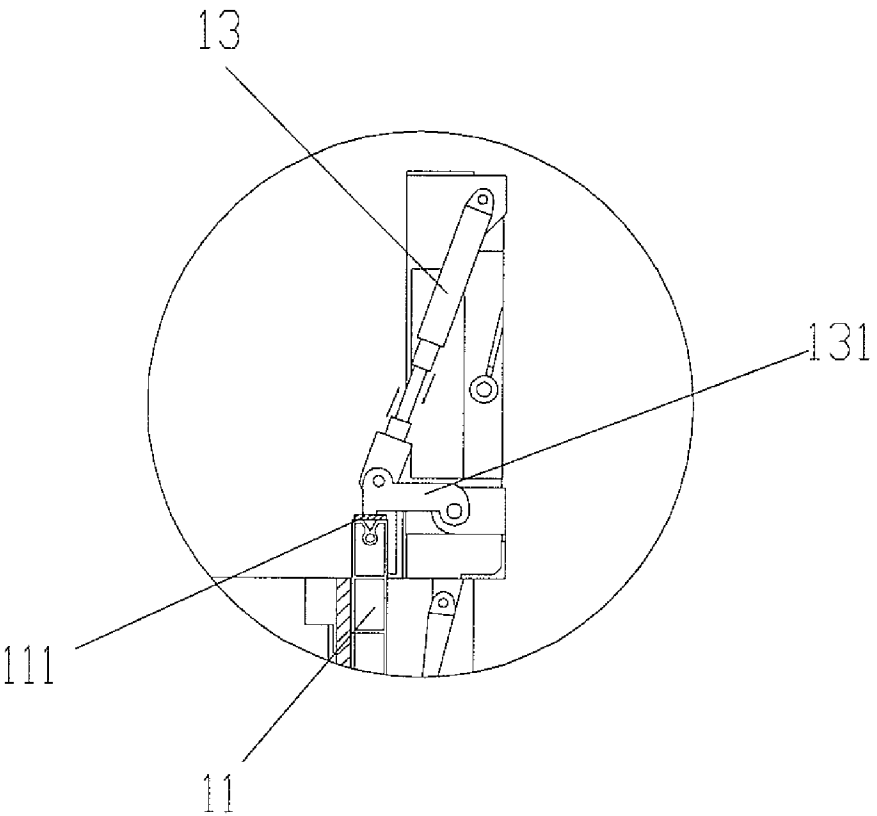
FIGS. 5 and 6 are locally enlarged operational views of the waterproof gate as shown in FIG. 4 in use.
Figure 5:
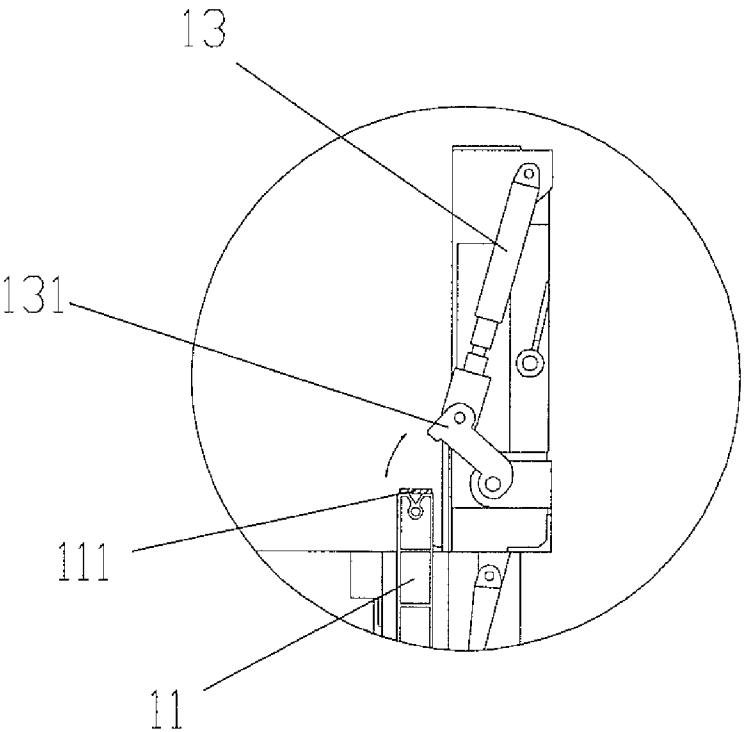
Figure 8:
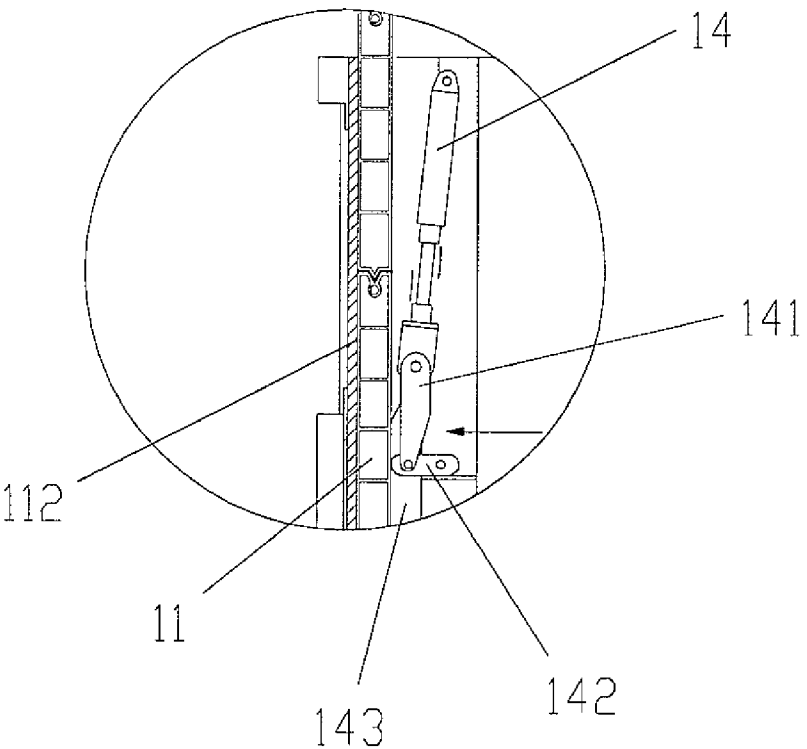
FIGS. 7 and 8 are locally enlarged operational views of the waterproof gate as shown in FIG. 4 in use.
Figure 7:
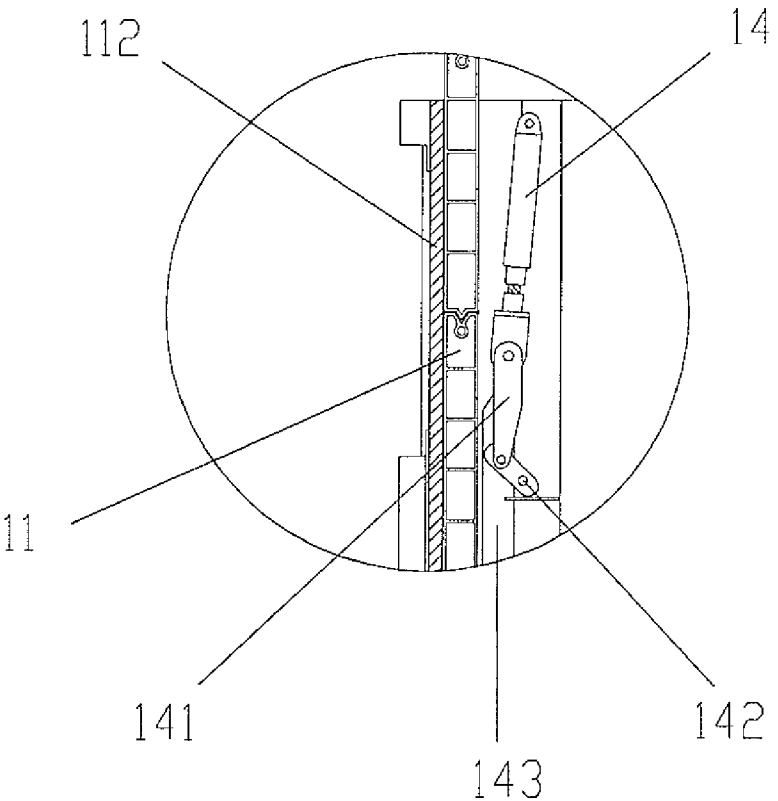

In operation, referring to FIGS. 4-8 with reference to FIGS. 1-3, when the water level detector 16 detects that the water level exceeds the preset value, the automatic controller 102 is driven by the drive motor 100 to move the waterproof door 11 downward so that the waterproof door 11 is moved down to press the ground tightly. In such a manner, the waterproof door 11 blocks the door frame 2 to provide a waterproof effect to the door frame 2. At the same time, the pressing bar 131 is driven downward by the first hydraulic cylinder unit 13 to press the waterproof door 11 downward as shown in FIGS. 5 and 6 so that the waterproof door 11 presses the ground more tightly to enhance the waterproof effect. At this time, the waterproof door 11 and the sealing gasket 111 are compressed by the pressing bar 131 so that the waterproof door 11 and the sealing gasket 111 are combined closely to enhance the waterproof effect. In addition, the push lever 141 is driven downward by the second hydraulic cylinder unit 14 to move the drive lever 142 which is driven to move the pressing plate 143 which is moved to abut the waterproof door 11 so as to press the waterproof door 11 transversely toward the waterproof strip 112 and to press the waterproof strip 112 toward the door frame 2 as shown in FIGS. 7 and 8 so that the door frame 2, the waterproof strip 112, and the waterproof door 11 are combined closely to enhance the waterproof effect.

Accordingly, when the water level exceeds a preset value, the waterproof door 11 is moved down to press the ground tightly so that the waterproof door 11 blocks the door frame 2 so as to provide a waterproof effect to the door frame 2. In addition, the pressing bar 131 is driven downward by the first hydraulic cylinder unit 13 to press the waterproof door 11 downward so that the waterproof door 11 presses the ground tightly so as to enhance the waterproof effect. Further, the waterproof door 11 and the sealing gasket 111 are compressed by the pressing bar 131 so that the waterproof door 11 and the sealing gasket 111 are combined closely so as to enhance the waterproof effect. Further, the push lever 141 is driven downward by the second hydraulic cylinder unit 14 to move the drive lever 142 which is driven to move the pressing plate 143 to abut the waterproof door 11 so as to press the waterproof door 11 transversely toward the waterproof strip 112 and to press the waterproof strip 112 toward the door frame 2 so that the door frame 2, the waterproof strip 112, and the waterproof door 11 are combined closely so as to enhance the waterproof effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A waterproof gate, comprising:

a door frame;

two side rails mounted on two opposite sides of the door frame;

a door mounted between the two side rails;

at least one sealing gasket mounted on the door; and at least one strip mounted between the door and the door frame;

a casing mounted on an upper end of the door frame;

a pressing bar movable to abut an upper end of the door so as to press the door downward;

a first hydraulic cylinder unit pivotally connected with the pressing bar to move the pressing bar relative to the door;

a pressing plate movable to abut the door so as to press the door toward the strip and to press the strip toward the door frame so that the door frame, the strip, and the door are combined;

a drive lever pivotally connected with the pressing plate to move the pressing plate relative to the door;

a push lever pivotally connected with the drive lever to move the drive lever; and a second hydraulic cylinder unit pivotally connected with the push lever to move the push lever;

wherein the pressing plate is movably mounted in one of the two side rails and is connected with the push lever and the drive lever;

the drive lever is pivotally mounted in the one of the two side rails and has a first end pivotally connected with the one of the two side rails and a second end pivotally connected with the push lever;

the push lever is pivotally mounted in the one of the two side rails and has a lower end pivotally connected with the second end of the drive lever and an upper end pivotally connected with the second hydraulic cylinder unit; and the second hydraulic cylinder unit is pivotally mounted in the one of the two side rails and has a lower end pivotally connected with the upper end of the push lever and an upper end pivotally connected with the one of the two side rails.

2. The waterproof gate of claim 1, wherein the waterproof gate further comprises:

a controller mounted in the casing and electrically connected with the door to control upward and downward movement of the door;

a drive motor mounted in the casing to drive the controller;

a hydraulic pump mounted in the casing and connected with the first hydraulic cylinder unit and the second hydraulic cylinder unit to supply hydraulic oil to the first hydraulic cylinder unit and the second hydraulic cylinder unit; and an uninterrupted power system mounted in the casing to supply an electric power when electricity fail occurs.

3. The waterproof gate of claim 1, wherein the waterproof gate further comprises:

an infrared safety detector mounted on a lower end of one of the two side rails.

4. The waterproof gate of claim 1, wherein the waterproof gate further comprises a water level detector disposed at a location flush with a bottom of each of the two side rails.

5. The waterproof gate of claim 1, wherein the pressing bar is pivotally mounted in the casing and has a first end pivotally connected with the casing and a second end that is pivotally connected with the first hydraulic cylinder unit and is movable to abut the upper end of the door; and the first hydraulic cylinder unit is pivotally mounted in the casing and has an upper end pivotally connected with the casing and a lower end pivotally connected with the second end of the pressing bar.

6. The waterproof gate of claim 1, wherein the door is disposed between the pressing plate and the strip.

* * * * *